US010332530B2

(12) United States Patent
Kleijn et al.

(10) Patent No.: US 10,332,530 B2
(45) Date of Patent: Jun. 25, 2019

(54) CODING OF A SOUNDFIELD REPRESENTATION

(71) Applicant: Google Inc., Mountain View, CA (US)

(72) Inventors: Willem Bastiaan Kleijn, Eastborne (NZ); Jan Skoglund, San Francisco, CA (US); Sze Chie Lim, San Francisco, CA (US)

(73) Assignee: GOOGLE LLC, Mountain View, CA (US)

( * ) Notice: Subject to any disclaimer, the term of this patent is extended or adjusted under 35 U.S.C. 154(b) by 84 days.

(21) Appl. No.: 15/417,550

(22) Filed: Jan. 27, 2017

(65) Prior Publication Data

US 2018/0218740 A1 Aug. 2, 2018

(51) Int. Cl.

| | |
|---|---|
| ***H04R 5/00*** | (2006.01) |
| ***G10L 19/008*** | (2013.01) |
| ***G10L 19/20*** | (2013.01) |
| ***G10L 19/24*** | (2013.01) |
| ***H04S 3/00*** | (2006.01) |
| *H04S 7/00* | (2006.01) |
| *G10L 19/16* | (2013.01) |

(52) U.S. Cl.

CPC ..... *G10L 19/008* (2013.01); *G10L 19/20* (2013.01); *G10L 19/24* (2013.01); *H04S 3/002* (2013.01); *H04S 3/008* (2013.01); *G10L 19/173* (2013.01); *H04S 7/308* (2013.01); *H04S 2420/11* (2013.01)

(58) Field of Classification Search

CPC ..... H04R 5/00

See application file for complete search history.

(56) References Cited

U.S. PATENT DOCUMENTS

| | | | | |
|---|---|---|---|---|
| 4,042,779 | A | 8/1977 | Craven et al. | |
| 9,531,998 | B1 * | 12/2016 | Farrell | A63F 13/352 |
| 9,813,811 | B1 * | 11/2017 | Sun | H04R 3/005 |
| 9,961,475 | B2 * | 5/2018 | Kim | G10L 19/20 |
| 2006/0126852 | A1 * | 6/2006 | Bruno | H04S 1/002 381/17 |
| 2010/0329466 | A1 * | 12/2010 | Berge | H04R 3/12 381/22 |
| 2012/0294446 | A1 * | 11/2012 | Visser | H04S 1/007 381/17 |

(Continued)

FOREIGN PATENT DOCUMENTS

| | | | |
|---|---|---|---|
| EP | 2469741 | A1 | 6/2012 |
| EP | 2800401 | A1 | 11/2014 |

OTHER PUBLICATIONS

Abrard, et al., "A time-frequency blind signal separation method applicable to underdetermined mixture of dependent sources", Signal Processing, vol. 85, No. 7, 2005, pp. 1389-1403.

(Continued)

*Primary Examiner* — Olisa Anwah

(74) *Attorney, Agent, or Firm* — Brake Hughes Bellermann LLP

(57) ABSTRACT

A method includes: receiving a representation of a soundfield, the representation characterizing the soundfield around a point in space; decomposing the received representation into independent signals; and encoding the independent signals, wherein a quantization noise for any of the independent signals has a common spatial profile with the independent signal.

20 Claims, 4 Drawing Sheets

(56) References Cited

U.S. PATENT DOCUMENTS

| | | | | |
|---|---|---|---|---|
| 2014/0358557 | A1* | 12/2014 | Sen | G10L 19/02 704/500 |
| 2015/0154965 | A1* | 6/2015 | Wuebbolt | G10L 19/008 704/500 |
| 2015/0248891 | A1* | 9/2015 | Adami | H04S 5/00 381/303 |
| 2015/0332679 | A1* | 11/2015 | Kruger | G10L 19/008 381/23 |
| 2015/0340044 | A1* | 11/2015 | Kim | G10L 19/002 381/23 |
| 2017/0148449 | A1* | 5/2017 | Kordon | G10L 19/008 |
| 2017/0164133 | A1* | 6/2017 | Gunawan | H04S 3/002 |
| 2017/0180902 | A1* | 6/2017 | Kordon | G10L 19/008 |
| 2018/0227665 | A1* | 8/2018 | Elko | H04R 1/406 |
| 2018/0308500 | A1* | 10/2018 | Krueger | G10L 19/008 |

OTHER PUBLICATIONS

Bach, et al., "Spectral clustering for speech separation", Automatic Speech and Speaker Recognition, 2009, pp. 221-250.
Cohen, "Relative transfer function identification using speech signals", IEEE Transactions on Speech and Audio Processing, vol. 12, No. 5, Sep. 2004, pp. 451-459.
Comon, "Independent component analysis, a new concept?", Signal Processing, vol. 36, No. 3, 1994, pp. 287-314.
Durlach, "Note on binaural masking-level differences at high frequencies", J. Acoust. Soc. Am., vol. 36, No. 3, Mar. 1964, pp. 576-581.
Frey, et al., "Clustering by passing messages between data points", Science, vol. 315, Feb. 16, 2007, pp. 972-976.
Gannot, et al., "Signal enhancement using beamforming and nonstationarity with applications to speech", IEEE Trans Signal Processing, vol. 49, 2001, pp. 1614-1626.
Girolami, "Mercer kernel based clustering in feature space", IEEE Trans. Neural Networks, vol. 13, No. 3, 2002, pp. 780-784.
Gribonval, et al., "A survey of sparse component analysis for blind source separation: principles, perspectives and new challenges", 14th European Symposium on Artificial Neural Networks, 2006, pp. 323-330.
Hirsh, "The Influence of interaural phase on interaural summation and inhibition", J. Acoust. Soc. Am., vol. 20, No. 4, Jul. 1948, pp. 536-544.
Hoshuyama, et al., "A robust adaptive beam-former for microphone arrays with a blocking matrix using constrained adaptive filters", IEEE Trans. Signal Processing, vol. 47, 1999, pp. 2677-2684.
Hyvaerinen, et al., "Independent component analysis: algorithms and applications", Neural networks, vol. 13, No. 4, 2000, pp. 411-430.
Li, et al., "Underdetermined blind source separation based on sparse representation", IEEE Transactions on Signal Processing, vol. 54, No. 2, Feb. 2006, pp. 423-437.
Markovich, et al., "Multichannel eigenspace beamforming in a reverberant noisy environment with multiple interfering speech signals", IEEE Transactions on Audio, Speech, and Language Processing, vol. 17, No. 6, Aug. 2009, pp. 1071-1086.
Ng, et al., "On spectral clustering: analysis and an algorithm", Advances in Neural Information Processing Systems, MIT Press, vol. 14, 2002, 8 pages.
Ozerov, et al., "Multichannel nonnegative matrix factorization in convolutive mixtures for audio source separation", IEEE Transactions on Audio, Speech, and Language Processing, vol. 18, No. 3, 2010, pp. 550-563.
Shalvi, et al., "System identification using nonstationary signals", IEEE Trans. Signal Processing, vol. 44, No. 8, Aug. 1996, pp. 2055-2063.
Shi, et al., "Normalized cuts and image segmentation", IEEE Trans. Pattern Anal. Mach. Intell., vol. 22, No. 8, 2000, pp. 888-905.
Van Dongen, "Graph clustering by flow simulation", Ph.D. dissertation, University of Utrecht, 2001, 175 pages.
Vlasblom, et al., "Markov clustering versus affinity propagation for the partitioning of protein interaction graphs", BMC Bioinformatics, vol. 10, No. 1, 2009, 14 pages.
Von Luxburg, et al., "A tutorial on spectral clustering", Statistics and Computing, vol. 17, No. 4, 2007, pp. 395-416.
Weisstein, "http://mathworld.wolfram.com/BesselFunctionoftheFirstKind.html", from MathWorld—A Wolfram Web Resource, retrieved on Jan. 25, 2017 from http://mathworld.wolfram.com/BesselFunctionoftheFirstKind.html, 6 pages.
Yilmaz, et al., "Blind separation of speech mixtures via time-frequency masking", IEEE Transactions on Signal Processing, vol. 52, No. 7, 2004, pp. 1830-1847.
International Search Report and Written Opinion for International Application No. PCT/US2017/059723, dated May 18, 2018, 15 pages.
Epain, et al., "Blind Source Separation Using Independent Component Analysis in the Spherical Harmonic Domain", Proc. of the 2nd International Symposium on Ambisonics and Spherical Acoustics, May 6-7, 2010, 6 pages.
Mitianoudis, et al., "Using Beamforming in the Audio Source Separation Problem", Signal Processing and Its Applications, 2003, Jul. 1-4, 2003, 4 pages.
Trevino, et al., "A Spatial Extrapolation Method to Derive High-Order Ambisonics Data From Stereo Sources", Journal of Information Hiding and Multimedia Signal Processing, vol. 6, No. 6, Nov. 1, 2015, pp. 1100-1116.

* cited by examiner

CODING OF A SOUNDFIELD REPRESENTATION

TECHNICAL FIELD

This document relates, generally, to coding a soundfield representation.

BACKGROUND

Immersive audio-visual environments are rapidly becoming commonplace. Such environments can require the accurate description of soundfields, usually in the form of a large number of audio channels. The storage and transmission of soundfields can be demanding, with rates generally similar to the requirements for the visual signals. Effective coding procedures for soundfields are therefore important.

SUMMARY

In a first aspect, a method includes: receiving a representation of a soundfield, the representation characterizing the soundfield around a point in space; decomposing the received representation into independent signals; and encoding the independent signals, wherein a quantization noise for any of the independent signals has a common spatial profile with the independent signal.

Implementations can include any or all of the following features. The independent signals comprise a mono channel and a number of independent source channels. Decomposing the received representation comprises transforming the received representation. The transformation involves a demixing matrix, the method further comprising accounting for a filtering ambiguity by replacing the demixing matrix with a normalized demixing matrix. The representation of the soundfield corresponds to a time-invariant spatial arrangement. The method further comprising determining a demixing matrix, and using the demixing matrix in computing a source signal from an ambisonics signal. The method further comprising estimating a mixing matrix from observations of the ambisonics signal, and computing the demixing matrix from the estimated mixing matrix. The method further comprising normalizing the determined demixing matrix, and using the normalized demixing matrix in computing the source signal. The method further comprising performing blind source separation on the received representation of the soundfield. Performing the blind source separation comprises using a directional-decomposition map, estimating an RMS power, performing a scale-invariant clustering, and applying a mixing matrix. The method further comprising performing a directional decomposition as a pre-processor for the blind source separation. Performing the directional decomposition comprises an iterative process that returns time-frequency patch signals corresponding to a location set for loudspeakers. The method further comprising making the encoding scalable. Making the encoding scalable comprises encoding only a zero-order signal at a lowest bit rate, and with increasing bit rate, adding one or more extracted source signals and retaining the zero-order signal. The method further comprising excluding the zero-order signal from a mixing process. The method further comprising decoding the independent signals.

In a second aspect, a computer program product is tangibly embodied in a non-transitory storage medium, the computer program product including instructions that when executed cause a processor to perform operations including: receiving a representation of a soundfield, the representation characterizing the soundfield around a point in space; decomposing the received representation into independent signals; and encoding the independent signals, wherein a quantization noise for any of the independent signals has a common spatial profile with the independent signal.

Implementations can include the following feature. The independent signals comprise a mono channel and a number of independent source channels.

In a third aspect, a system includes: a processor; and a computer program product tangibly embodied in a non-transitory storage medium, the computer program product including instructions that when executed cause the processor to perform operations including: receiving a representation of a soundfield, the representation characterizing the soundfield around a point in space; decomposing the received representation into independent signals; and encoding the independent signals, wherein a quantization noise for any of the independent signals has a common spatial profile with the independent signal.

BRIEF DESCRIPTION OF DRAWINGS

Like reference symbols in the various drawings indicate like elements.

DETAILED DESCRIPTION

Figure 1:
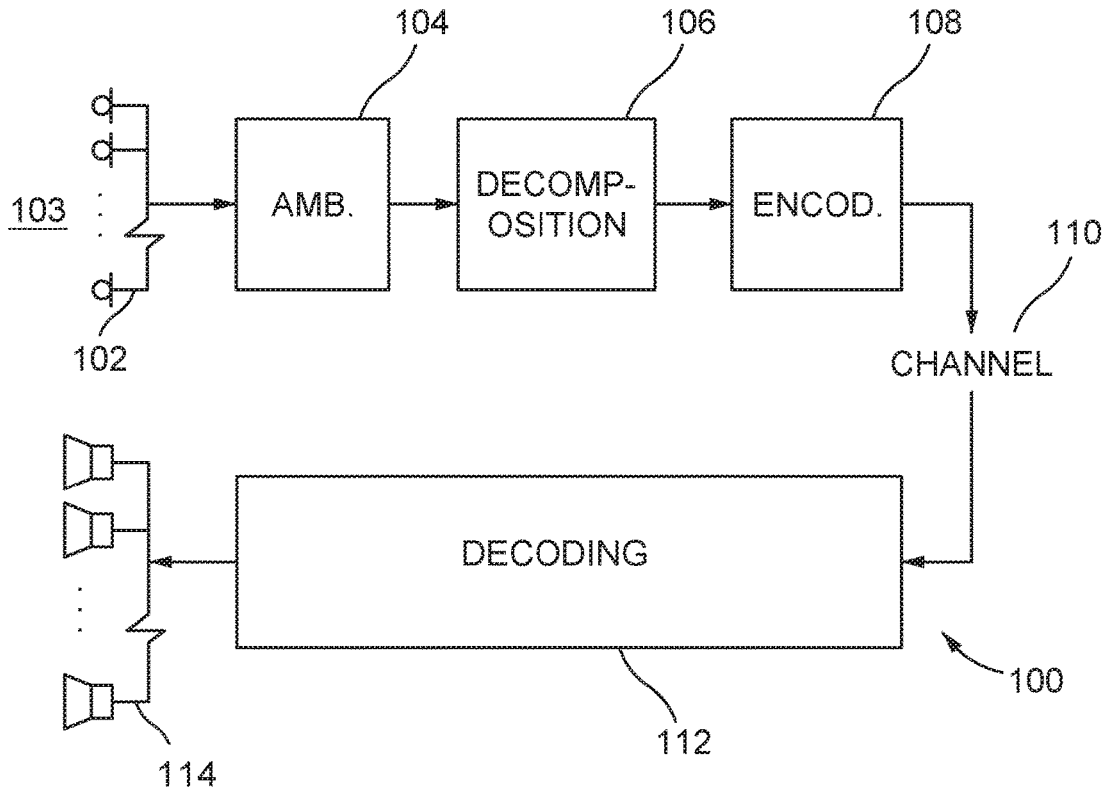
FIG. 1 shows an example of a system.

This document describes examples of coding soundfield representations that characterize the soundfield directly, such as an ambisonics representation. In some implementations, the ambisonics representation can be decomposed into 1) a mono channel (e.g., the zero-order ambisonics channel) and 2) an arbitrary number of independent source channels. Coding can then be performed on this new signal representation. Examples of advantages that can be obtained include: 1) the spatial profile of the quantization noise and the corresponding independent signal are identical, which can maximize the perceptual masking and lead to minimal coding rate requirements; 2) the independent encoding of the independent signals can facilitate a globally optimal encoding of the ambisonics signal; and 3) the mono channel together with the progressive adding-in of individual sources can facilitate scalability, good quality and directionality compromises at high and low rates. In some implementations, the conversion of the signal from $(N+1)^2$ channels to, say, M independent sources involves a multiplication by a demixing matrix. Moreover, for a time-invariant spatial arrangement the matrices can be time-invariant, which can lead to only little side information being required. Also, the rate can vary with the number of independent sources. For each independent source directionality for that source can be added, effectively in the form of the room response described by the rows of the inverses of the demixing matrices for all the frequency bins. In other words, when an extracted source is added, it can go from being in the mono channel to being as it is heard in the context of the recording environment. In some implementations, the rate can be essentially independent of the ambisonics order N.

Implementations can be used in various audio or audio-visual environments, such as immersive ones. Some implementations can involve virtual reality systems and/or video content platforms.

Various ways of representing sound exist. Ambisonics, for example, is a representation of a soundfield using a number of audio channels that characterize the soundfield around a point in space. From another viewpoint, ambisonics can be considered as a Taylor-like expansion of the soundfield around that point. The ambisonics representation describes the soundfield around a point (generally the location of the user). It characterizes the field directly, thus differing from methods that describe a set of sources driving the field. For example, a first-order ambisonics representation characterizes sound using channels W, X, Y and Z, where W corresponds to a signal from an omnidirectional microphone, and X, Y and Z correspond to signal associated with the three spatial axes, such as might be picked up by figure-of-eight capsules. Some existing coding methods for ambisonics appear to be heuristic, with no clear sense of why a particular method is good, other than by listening.

The ambisonics representation is independent of the rendering method, which can use, for example, headphones or a particular loudspeaker arrangement. The representation is also scalable: low-order ambisonics representations, which have less directional information, form a subset of high-order descriptions that have more directional information. For example, the scalability and the fact that the representation describes the soundfield around the user directly has made ambisonics a common representation for virtual reality headset applications.

An ambisonics representation can be generated with a multi-microphone assembly. Some microphone systems are configured for generating the ambisonics representation directly, and in other cases a separate unit can be used for the generation. Ambisonics representations can have different numbers of channels, such as 9, 25 or 36 channels, or in principle any square integer number of channels. An ambisonics representation can be visualized as analogous to a sphere: inside the sphere the description of the sound is accurate, and outside the sphere the description is less accurate or inaccurate. With a higher order ambisonics representation, the sphere can be considered to be larger. In essence, a higher order ambisonics implementation can be used in order to obtain a better resolution of sound, in that the location of sound can be identified with more accuracy, and the sound characterization goes further from the center of the sphere. For example, the ambisonics representation can be of sounds coming from sources that are unknown to the user, so the ambisonics channels can be used to discriminate and dissolve between these sources.

The present disclosure describes that the perception of quantization noise becomes clearer if the quantization noise of an independent signal component signal, and that independent signal component, have different directionalities. The term directionality implies the full map that maps the scalar independent signal component into its ambisonics vector signal representation. For a time-invariant spatial arrangement this map is time-invariant and corresponds to a generalized transfer function. If the quantization noise is perceptually clearer, then the coding rate will go up for equal perceived sound field quality. However, the channels of the ambisonics representation each contain mixtures of independent signals, which can make this issue difficult to resolve. On the other hand, it would be advantageous to be able to use existing mono audio coding schemes in the process.

FIG. 1 shows an example of a system 100. The system 100 includes multiple sound sensors 102, including, but not limited to, microphones. For example, one or more omnidirectional microphones and/or microphones of other spatial characteristics can be used. The sound sensors 102 detect audio in a space 103. For example, the space 103 can be characterized by structures (such as in a recording studio with a particular ambient impulse response) or it can be characterized as being essentially free of surrounding structures (such as in a substantially open space). The output of the sound sensors can be provided to a module 104, such as an ambisonics module. Any processing component can be used that generates a soundfield representation that characterizes the sound directly, as opposed to, say, in terms of one or more sound sources. The ambisonics module 104 generates as its output an ambisonics representation of the soundfield detected by the sound sensors 102.

The ambisonics representation can be provided from the ambisonics module 104 to a decomposition module 106. The module 106 is configured for decomposing the ambisonics representation into a mono channel and multiple source channels. For example, matrix multiplication can be performed in each frequency bin of the soundfield representation. The output of the decomposition module 106 can be provided to an encoding module 108. For example, an existing coding scheme can be used. After encoding, the encoded signal can be stored, forwarded and/or transmitted to another location. For example, a channel 110 represents one or more ways that an encoded audio signal can be managed, such as by transmission to another system for playback.

When the audio of the encoded signal should be played, a decoding process can be performed. In some implementations, the system 100 includes a decoding module 112. For example, the decoding module can perform operations in essentially the opposite way than in the respective modules 104, 106 and 108. For example, an inverse transform can be performed in the decoding module that partially or completely restores the ambisonics representation that was generated by the module 104. Similarly, the operations of the decomposition module 106 and the encoding module 108 can have their opposite counterparts in the decoding module 112. The resulting audio signals can be stored and/or played depending on the situation. For example, the system 100 can include two or more audio playback sources 114 (including, but not limited to, loudspeakers) to which the processed audio signal can be provided for playback.

In some implementations, the soundfield representation is not associated with a particular way of playing out the audio description. The soundfield description can be played out over a headphone, and the system can then compute what should be rendered in the headphones. In some implementations, the rendering can be dependent how the user turns his or her head. For example, a sensor can be used that informs the system of the head orientation, and the system can then cause the person to hear the sound coming from a direction that is independent of the head orientation. As another example, the soundfield description can be played out over a set of loudspeakers. That is, first the system can store or transmit the description of the soundfield around the listener. At the rendering system, a computation can then be made what the individual speakers should produce to create the soundfield around the listener's head, or the impression of that soundfield around the head. That is, the soundfield can be a definition of what the resulting sound around the listener should be, so that the rendering system can process that information and generate the appropriate sound to accomplish that result.

Figure 2A:
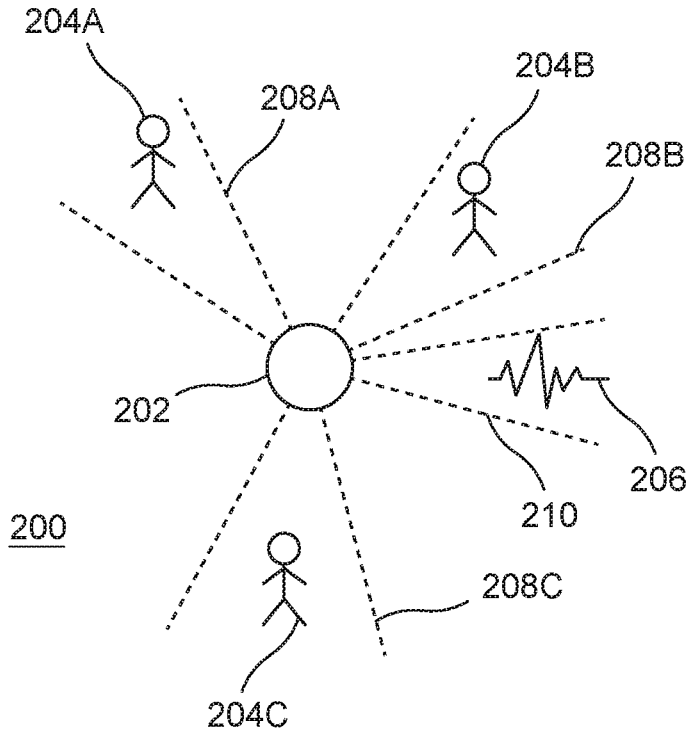
FIGS. 2A-B schematically show examples of spatial profiles.
Figure 2B:
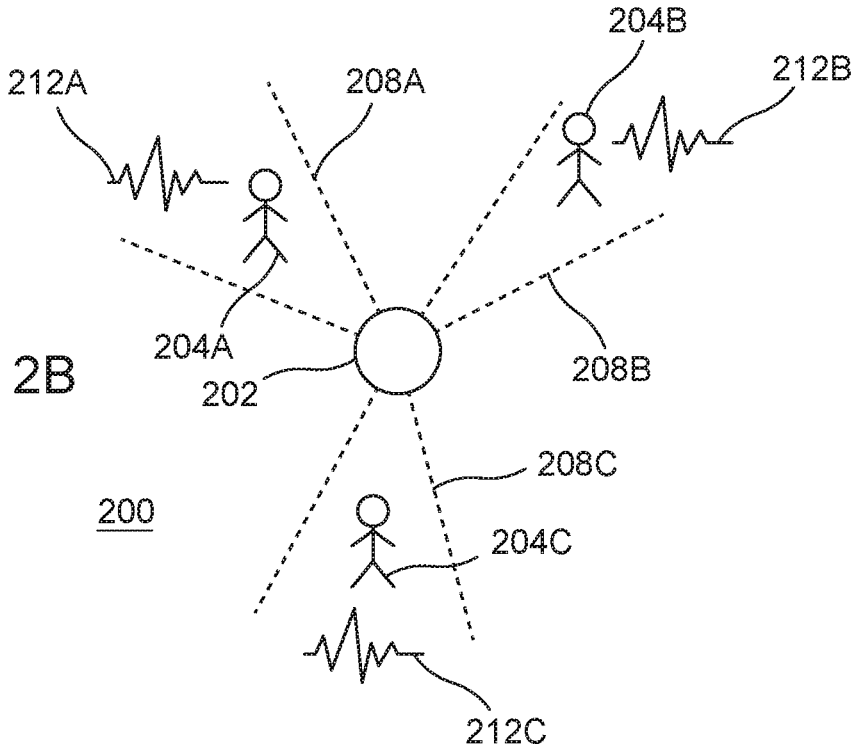

FIGS. 2A-B schematically show examples of spatial profiles. These examples involve a physical space 200, such as a room, an outdoors area or any other location. A circle 202 schematically represents a listener in each situation. That is, a soundfield representation is going to be played to the listener 202. For example, the soundfield description can correspond to a recording that was made in the space 200 or elsewhere. People 204A-C are schematically illustrated as being in the space 200. The people symbols represent voices (e.g., speech, song or other utterances) that the listener can hear. The locations of the people 204A-C around the listener 202 indicate that the sound of each individual person is here to arrive at the listener 202 from a separate direction. That is, the listener should hear the voices as coming from different directions. In the context of a room, the notion of a spatial profile is a generalization of this illustrative example. The spatial profile then includes both the direct path and all the reflective paths through which the sound of the source travels to reach the listener 202. Hence, from here onward, the term "direction" can be taken as having a generalized meaning and to be equivalent to a set of directions representing the direct path and all reflective paths.

Coding of an audio signal may not, however, be a perfect process. For example, noise can be generated. In some implementations, it may be preferable to have as much noise as possible, as long as the noise is not perceptible to the listener. Namely, the more noise that is generated, the lower is the bitrate. That is, the system can seek to be as imprecise as practically possible to lower the number of bits that it needs to use to transmit the signal.

More particularly, the encoding/decoding process for an audio representation can be considered a tradeoff between the perceived severity of signal distortion and signal-independent noise on the one hand, and the coded bit rate on the other. For example, in many audio-coding methods signal-correlated distortion and signal-independent noise are lumped together. A squared error (such as with perceptual weighting) can then be used as a fidelity measure. This "lumped" approach can have shortcomings that can also be relevant in the coding of a soundfield representation. For example, the human auditory periphery can interpret differently inaccuracy in directional information (e.g., distortion) and signal-independent noise. In this disclosure, signal-independent signal error resulting from quantization will be referred to as quantization noise. Hence, when coding a soundfield representation, it can be important to provide a balance between signal attributes that are perceived as separate dimensions, and facilitate an adjustment of that balance to suit the application.

Here, noise 206 is schematically illustrated in the space 200 in FIG. 2A. That is, the noise 206 is associated with the encoding of the audio from one or more of the people 204A-C. However, because the example in FIG. 2A does not use decomposition of a soundfield representation according to the present disclosure, the noise 206 does not appear to come from the same direction as any of the voices of the people 204A-C. Rather, the noise 206 appears to come from another direction in the space 200. Namely, each of the people 204A-C can be said to have associated with them a corresponding spatial profile 208A-C. The spatial profile corresponds to how the sound from a particular talker is captured: some of it arrives directly from the talker into the microphone, and other sound (generated simultaneously) first bounces on one or more surfaces before being picked up. Each talker can therefore have his or her own distinctive spatial profile. That is, the voice of the person 204A is associated with the spatial profile 208A, the voice of the person 204B with the spatial profile 208B, and so on.

The noise 206, on the other hand, is associated with a spatial profile 210 that does not coincide with either of the spatial profiles 208A-C. Here, the spatial profile 210 does not even overlap with either of the spatial profiles 208A-C. This can be perceptually distracting to the listener 202, such as because they may not expect any sound (whether a voice or noise) to come from the direction associated with the spatial profile 210. For example, the listener 202 can pick up the noise 206 more quickly because it came from a direction that is different from the original sources.

In FIG. 2B, on the other hand, the example does use decomposition of a soundfield representation according to the present disclosure. As a result, any noise generated in the audio processing (e.g., due to the coding stage) gets essentially the same spatial profile as the sound that was being processed when the noise occurred. That is, in the decomposition process, audio sources are individualized to channels with their respective directions. These can then be coded individually. As a result, when noise is created, the noise can have the exact same spatial profile as the source of the noise. Here, for example, the voices of the people 204A-C give rise to respective noise signals 212A-C. However, the noise signal 212A has the same spatial profile 208A as does the voice of the person 204A, the noise signal 212B has the same spatial profile 208B as the person 204B, and so on. As a result, none of the noises 212A-C appears to come from a direction other than that of the voice that caused it. In particular, none of the noises 212A-C comes from a direction in the space 200 that is otherwise free of sound sources. One way of characterizing this situation is to describe the voices of the persons 204A-C as masking the respective noise 212A-C coming from that sound source. As a result, the system can go down in bit rate when operating at the threshold of just noticeable quantization noise. That is, after the separate coding, the signals can be assembled together again, including their respective noises. That is, each signal can include also a mono signal and a mono noise signal associated with it. These can then become spread over the space 200, while the noise and the voice (e.g., a talker) have the same spatial profile.

In general, the following explains the use of ambisonics in characterizing a soundfield, in terms of describing the soundfield with spherical harmonics. As mentioned, the description can be a characterization of a soundfield around a point in space. Here, it is assumed that no sources or objects are present in the region of the characterization.

The following describes the path from a wave equation to the ambisonics B-format. Acoustic waves must satisfy the wave equation:

$$\nabla^2 u(r,t) - \frac{1}{c^2}\frac{\partial^2}{\partial t^2}u(r,t) = 0. \tag{1}$$

The temporal Fourier transform of the wave equation is the Helmholz equation:

$$\nabla^2 u(r;k) + k^2 U(r;k) = 0, \tag{2}$$

where $$k = \frac{\omega}{c}$$

is the wavenumber, with c the speed of sound and co the frequency in radians per second.

To describe the acoustic soundfield around a point in space it may be natural to use spherical coordinates with radius r and elevation θ and azimuth ϕ. In these coordinates, a general solution to the equation (2) for a free-space region without sources can be written as an expansion in spherical harmonics, e.g., $$U(r, \theta, \phi, k) = \sum_{n=0}^{\infty} \sum_{m=-n}^{n} j^n B_n^m(k) j_n(rk) Y_{nm}(\theta, \phi), \tag{3}$$

where $j=\sqrt{-1}$, $j_n(\bullet)$ is a spherical Bessel function of the first kind and $$Y_{nm}(\theta, \phi) = \sqrt{\frac{2n+1}{4\pi} \frac{(n-|m|)!}{(n+|m|)!}} P_{n|m|}(\cos(\theta)) e^{im\phi} \tag{4}$$

is a spherical harmonic of order n and mode m, with $P_{nm}(\bullet)$ the associated Legendre function. In some implementations, the solution for outgoing waves can be omitted because a space is considered that has no objects and sound sources.

The soundfield can be specified with the coefficients $B_n^m(k)$ and this is what is used in the so-called ambisonics B-format. The B-format can be provided as a time-frequency transform, for example with the transform being based on a tight-frame representation. For example, a tight frame can imply that squared-error measures are invariant with the transformation, except for scaling. The B-format coefficients can then be of the form $B_n^m(l, q)$, where l is a time index and q is a discrete frequency index that is linearly related to k. Let $\mathcal{K}$ be the set of discrete frequencies of the representation. Then the time-frequency representation $B_n^m: \mathbb{Z} \times \mathcal{K} \rightarrow \mathbb{R}$ can be converted to time-domain signals $b_n^m: \mathbb{Z} \rightarrow \mathbb{R}$ by way of a sequence of inverse discrete Fourier transforms $\mathcal{F}^{-1}$:

$$b_n^m = \sum_l T_{l\alpha\mathcal{K}} H \mathcal{F}^{-1} B_n^m(l, \cdot), \tag{5}$$

where $\mathcal{F}^{-1}$ returns $\mathcal{K}$ time-domain samples corresponding to the coefficients $B_n^m(l,\bullet)$, H is an $\mathcal{K} \times \mathcal{K}$ diagonal windowing matrix, $T_l$ is an operator that pads the input with zeros to render it an infinite sequence with the support centered at the origin and then advances it by l samples, and a is chosen such that $\alpha\mathcal{K}$ is the number of samples time-advance between the blocks of the time-frequency transform.

The following exemplifies some specific soundfields. One example of a soundfield to study is the plane wave. Consider a plane wave incident at azimuth and elevation coordinates (θ, ϕ) with driving signal S(l, q). The plane wave can be described with coefficients $$B_n^m(l,q) = S(l,q) Y_{nm}(\theta, \phi). \tag{6}$$

One then obtains a multiplication of spherical harmonics in the spherical harmonic expansion U(r, θ, ϕ, k).

For a spherical sound wave with driving signal S(l, q) originating from a source at distance p in the direction (θ, ϕ) the ambisonics B-format coefficient can be $$B_n^m(l, q) = S(l, q) Y_{nm}(\theta, \phi) \sum_{n=0}^{m} \frac{(m+n)!}{(m-n)!n!} \left(\frac{-j}{k\rho}\right)^n. \tag{7}$$

Equation (7) includes a dependency $$\frac{1}{\rho^n}$$

on the radius; for a given frequency, the near-field effect amplifies the low-order terms. That is, relatively less directional detail may be needed to represent the soundfield component generated by nearby sources. The effect can appear progressively earlier at low frequencies; it is a result of the spherical Bessel function. This can imply that nearby sources are perceived as having a larger effective aperture. At sufficiently low frequencies, the sound directionality can effectively be lost for nearby sources as essentially all signal power resides in the zero-order coefficient $B_0(l, q)$. For example, consumer audio equipment can use a single loudspeaker for low-frequency sound as it is necessarily generated from nearby. On the other hand, in the animal world, elephants can determine the direction of other elephants by communication at frequencies below the range of human hearing.

The above indicates that in typical sound recordings the low-order ambisonics coefficients are low-pass and the high-order ambisonics coefficients are high-pass. If the scalability of ambisonics is exploited then these effects should be accounted for. In fact, the circumstance that in synthetic scenarios the time domain signals of the format (5) are usually created without spectral bias (i.e., are inherently far-field), and naturally recorded scenarios have these biases (i.e., are necessarily near-field) can lead to incorrect conclusions about shortcomings of microphones.

The following exemplifies an ambisonics approach. In practical applications the expansion (3) can be truncated. The task can then be to seek the optimal coefficients $B_n^m(k)$ to describe the soundfield. One possible approach is to determine the coefficients that minimize an L2 norm (a least-squares solution) or an L1 norm on a ball of radius r. The L2 answer may not be trivial; while the spherical harmonics are orthonormal on the surface of a sphere, the expansion (3) may not be orthonormal inside a ball of given radius as the spherical Bessel functions of different order have no standard orthogonality conditions. One could obtain an orthogonal set of functions on a ball of a particular radius by numerical evaluation of the inner-products; this can be done for each wave number k. The ambisonics approach, on the other hand, can take a different approach.

Consider the following expression for the spherical Bessel function of the first kind with $m \in \mathbb{Z}^*$:

$$j_m(r) = \sum_{l=0}^{\infty} \frac{(-1)^l}{2^{2l+m} l!(m+l)!} r^{2l+m}. \tag{8}$$

This can be interpreted as a Taylor series expansion and it can be proven that it converges in a region [0, a) for an a. Similarly it can be assumed that all derivatives converge.

In equation (8), the lowest power of r is m. The assumptions can then imply that if an arbitrarily small error ∈ in U(r, θ, φ, k) is allowed, then one can always find a radius within which one can neglect terms higher than the first term of $j_0(r)$ in the expansion of equation (3). This can be generalized if one considers derivatives: if one allows an arbitrarily small error ∈ in the q'th derivative of U(r, θ, φ, k) to r, then one can always find a sufficiently small radius within which only the derivatives of the q'th term of $j_0$, the q−1'th term of $j_1$ up to the first term of $j_q$ (r) need to be considered.

That is, higher-order ambisonics seeks to match the radial derivatives of the soundfield at the origin in all directions up to a certain radial derivative (i.e., the order). In other words, it can be interpreted as being akin to a Taylor series. In its original form, ambisonics seeks to match only the first-order slopes and does so directly from measurements, as will be discussed below. In later forms, higher order terms are also included.

As mentioned, ambisonics does not attempt to reconstruct the soundfield directly, but rather characterizes the directionality at the origin. The representation is inherently scalable: the higher the value of the truncation of n in the equation (3) (i.e., the ambisonics order), the more precise the directionality. Moreover, at any frequency the soundfield description is accurate over a larger ball for a higher order n. The radius of this ball is inversely proportional to the frequency. For example, a good measure of the size of the ball may be the location of the first zero of $j_0(\bullet)$. Low order ambisonics signals are embedded in higher-order descriptions.

The following describes how ambisonics renders a mono signal. At the origin the zero-th order spherical harmonic is the mono signal. However, at the zero of the zero-th order Bessel function this "mono" signal component is zero. The location of the zero moves inward with increasing frequency. The amplitude modulation of the spherical harmonic is a physical effect; when one creates the right signal at the center of a ball and insists on a spherically symmetric field, then it will vanish at a particular radius. The question can arise whether this is perceptible if the soundfield is placed around the human head. The question may be difficult to answer since the presence of the human head changes the soundfield. However, if one replaces the human head with microphones in free space, then the zeros will be observed physically. Hence, it may be difficult to assign a weighting to the B-format coefficients that reflects their perceptual relevance.

The following describes rendering of ambisonics, with a focus on binaural rendering. Ambisonics describes a soundfield around a point. Hence, rendering of ambisonics is decoupled from the ambisonics representation. For any arrangement of loudspeakers one can compute the driving signals that make the soundfield near the origin close to what the ambisonics description specifies. However, at higher frequencies the region where the ambisonics description is correct is in practice often small, much smaller than a human head. What happens outside that region of high accuracy depends on the rendering used and on any approximations made. For example, for a physical rendering system consisting of a number of loudspeakers one can either i) account for the distance between loudspeaker and origin, or ii) assume that the loudspeakers are sufficiently far from the origin to use a plane wave approximation. In fact, as will be discussed below, for binaural rendering a nominally correct rendering approach that accounts for the location of the headphones with respect to the origin does not perform well for high frequencies.

The following describes direct binaural rendering. In this context, it can be illustrative to discuss the effect of the Bessel functions in the equation (3). One approach can be to ignore the physical presence of the head and simply compute the soundfield at the location of the ears. As noted above, only the zero-order (n=0) Bessel function contributes to the signal at the spatial origin. The component is commonly interpreted as the "mono" component. However, the n=0 component does not contribute everywhere. The zero of $j_0(\bullet)$ occurs at rk=π, which is $$\frac{r\omega}{c} = \pi \text{ or } f = \frac{\pi c}{2\pi r} \approx 170r^{-1}.$$

Thus, at 0.1 m radius the zero-order spherical harmonic does not contribute at 1700 Hz. Similarly, for r=0.1 m radius the first zero for $j_1(\bullet)$ is at around 2300 Hz. Thus, if a soundfield that is not spherically symmetric is to be described accurately, other ambisonics terms must provide the signal at those spatial zeros. The ambisonics representation therefore cannot be statistically independent.

The above numerical examples show that one should be careful with binaural rendering of low-order ambisonics. This likely is the reason that direct computation of the soundfield at the location of the ears appears to not be used for binaural rendering. Instead, the sound pressure is computed indirectly, which means that the aforementioned zero issue is never explicitly noted. However, that does not mean that it is not present.

The following describes indirect binaural rendering. The spatial zeros in direct binaural rendering are a direct result of the binaural rendering and would generally not occur when using rendering with loudspeakers. When rendered with loudspeakers, the signal consists of a combination of (approximate) plane waves arriving from different angles. Binaural rendering based on ambisonics can then be performed using virtual plane waves that provide the correct soundfield near the coordinate origin (even if that approximation is right only within a sphere that is smaller than the human head). The approach can be based on equation (6), as mode matching leads to a vector equality that allows conversion of the coefficients into the amplitudes of a set of planes waves given their azimuths and elevations. Depending on the number of virtual loudspeakers one may need a pseudo-inverse to make this computation, which can be the Moore-Penrose pseudo-inverse. The Moore-Penrose pseudo-inverse approach can compute amplitudes for the set of plane waves that correspond to the lowest total energy that gives rise to the desired soundfield near the origin. In some situations use of a pseudo-inverse may not be motivated. These plane waves can then be converted to the desired binaural signal using an appropriate head-related transfer function (HRTF). If the head is rotated, the azimuth and elevation of the microphones and the associated HRTF are to be adjusted accordingly.

Consider a sufficiently large set of loudspeakers $\mathcal{J}$ at the surface of an infinite sphere. A loudspeaker i has an elevation and azimuth ($\theta_i$, $\phi_i$) and produces a signal $S_i(k)$ at frequency k. Near the origin, the rendered signal is then, using the equation (6):

$$U(r, \theta, \phi, k) = \sum_{n=0}^{\infty} \sum_{m=-n}^{n} j^n B_n^m(l, q) j_n(rk) Y_{nm}(\theta, \phi) \tag{9}$$

-continued $$= \sum_{i \in \mathcal{J}} \sum_{n=0}^{\infty} \sum_{m=-n}^{n} j^n S_i(l, q) j_n(rk) Y_{nm}(\theta, \phi) Y_{nm}(\theta_i, \phi_i).$$

For a finite order N one can obtain $$U(r, \theta, \phi, k) = \sum_{i \in \mathcal{J}} \sum_{n=0}^{N} \sum_{m=-n}^{n} j^n S_0(l, q) j_n(rk) Y_{nm}(\theta, \phi) Y_{nm}(\theta_i, \phi_i) + \epsilon, \tag{10}$$

where the error $\in$ is orthogonal in the elevation-and-azimuthal space to the spherical harmonics below order N.

The equation (10) may be a complicated way of writing the mode matching equation that could have been written directly from equation (6):

$$B_n^m(l, q) = \sum_{i \in \mathcal{J}} Y_{nm}(\theta_i, \phi_i) S_i(l, q). \tag{11}$$

Now, let B(l, q) be the stacking of the $B_n^m(l, q)$ and let $Y_i$ be the stacking of $Y_{nm}(\theta_i, \phi_i)$, both over n and m. The dimensionality of these column vectors is $P=\Sigma_{n=0}^{N} 2n+1=(N+1)^2$. Furthermore let $Y=[Y_1, \ldots, Y_{|\mathcal{J}|}]$ and $S(k)=[S_1(k), \ldots, S_{|\mathcal{J}|}(k)]^T$. Then one can rewrite equation (11) as $$B(k)=YS(k). \tag{12}$$

For $|\mathcal{J}| \geq P$ in equation (12) the computation of S(k) from B(k) is underspecified and many different solutions are possible for the loudspeaker signals S(k). One can select the solution that uses the least loudspeaker power. In other words, one can prefer the S(k) that is zero in the null space of Y, which can be written as $(I-Y^H(YY^H)^{-1}Y)S(k)=0$. Substituting YS(k)=B(k) in this expression one can obtain the desired solution $$S(k)=Y^H(YY^H)^{-1}B(k), \tag{13}$$

which is just the definition of the Moore-Penrose pseudo-inverse.

Once one has the signals for the infinitely distant virtual loudspeakers, one can compute the signals for the loudspeakers in the headset. One multiplies the signals $S_i(k)$ with the HRTF for the corresponding ear. For each ear individually, one can then sum over all the scaled virtual loudspeaker signals, and finally perform the inverse time-frequency transform (5) to get a time-domain signal, and play the result out from the headphone.

For the indirect binaural rendering method the relationship between the ambisonics representation and the signal heard by the listener is linear but may not be straightforward. As the HRTF varies with head rotation, masking levels for the virtual loudspeaker signals depend on head rotation. This can suggest usage of a minimax approach to ensure transparent coding for any head rotation.

When using indirect rendering, the problem of spatial zeros discussed above does not seem to appear. In part that may be because it is not visible from this perspective. More importantly, even if the plane wave approximation is accurate near the origin, it differs from the truncated spherical-harmonics representation (10) outside the ball where the latter representation is accurate. While interference between the plane waves may lead to spatial zeros, they likely are points rather than spherical surfaces.

The following description relates to multi-loudspeaker rendering. The rendering over physically fixed loudspeakers can be similar to the principle described above for the loudspeakers at infinity. It can be important to account for the phase difference associated with the distance of the loudspeaker. Alternatively, one can replace the plane wave approximation with the more accurate spherical wave description given in equation (7). This already accounts for the phase correction for the distance.

The following description relates to perceptual coding of ambisonics. The coding of the ambisonic representation will be described. One difficulty with encoding an ambisonics representation can be that the appropriate masking is not well understood. Ambisonics describes the soundfield without the physical presence of the listener. This is easily seen when one considers the original ambisonics recording method: it applies a correction to recording for the Bessel functions and the cardioid microphone. If rendered by loudspeakers, the presence of the listener modifies the soundfield but this approximates what would happen in the original sound-field scenario. The soundfield at the ear depends on the orientation of the listener and on the physical presence of the listener. In binaural listening the soundfield is corrected for the presence of the listener with the HRTF. The HRTF selection depends on the orientation of the listener.

In conventional audio coding the orientation of the listener may also not be known a-priori. This is of no consequence for the coding of mono signals. For conventional multi-channel systems the problem of a lack of understanding of the masking behavior does exist. However, as conventional systems do not rely on the interference of the individual loudspeaker signals to create directionality, it is more natural to consider masking for the loudspeaker signals individually.

In the following description, some background on binaural masking is first provided, and then a number of desirable attributes and alternative approaches for ambisonics coding are discussed. Finally, one approach is discussed in more detail.

The following description relates to binaural hearing. The rendered audio signal can generally be perceived by both ears of the listener. One can distinguish a number of cases. The dichotic condition occurs when the same signal is heard in both ears. If the signal is only heard in one ear, the monotic condition occurs. The masking levels for the monotic and dichotic conditions are identical. More complex scenarios generally correspond to the dichotic condition, where the masker and maskee have a different spatial profile. An attribute of a dichotic condition is the masking level difference (MLD). The MLD is the difference in masking level between the dichotic scenario and the corresponding monotic condition. This difference can be large below 1500 Hz, where it can reach 15 dB; above 1500 Hz the MLD decreases to about 4 dB. The values of the MLD show that, in general, masking levels can be lower in the binaural case, and signal accuracy must be commensurably higher. For some applications this implies that a high coding rate is required for a dichotic scenario.

Consider a concrete example. Scenario A is a directional scenario where a source signal is generated at a particular point in free space (no room is present). One can code the signals for the two ears of the listener, independently. On the other hand, scenario B presents the same single-channel signal to both ears simultaneously. Only one encoding may need to be performed. It may seem that the two-channel scenario A would require twice the coding rate of single-channel scenario B. However, it can be the case that one must encode each channel of scenario of channel A with higher precision than the single channel for scenario B. Thus, the coding rate required for scenario A can be more than twice the rate required for scenario B. This is the case because the quantization noise does not have the same spatial profile.

A separate issue is contralateral, or central, masking, which can occur when one hears the signal in one ear and hears simultaneously an interferer in the other ear. The masking by the interferer may be very weak. In some implementations, it is so weak that it need not be considered in the audio coding designs. In the following discussions it will not be considered.

The following description is a comparative discussion of approaches to coding ambisonics. To construct an ambisonics coding scheme, one can account for the attributes of spatial masking discussed above. Two contrasting paradigms can be considered: i) the direct coding paradigm: code the B-format time frequency coefficients directly and attempt to find a satisfactory mechanism to define the masking levels for the B-format coefficients, ii) a transform coding paradigm: transform the B-format time-frequency coefficients to a time-frequency domain signals where the computation of masking levels is relatively straightforward. An example of such a transformation is the transformation of the ambisonics representation to a set of signals arriving from specific directions (or, equivalently, from loudspeakers on a sphere at infinite distance), which will be referred to as directional decomposition. The basic directional coding algorithm is outlined below.

An apparent advantage of the direct coding paradigm can be that the scalability with respect to directionality would carry over to the coded streams. However, the computation of the masking levels may be difficult and, moreover the paradigm can lead to dichotic masking conditions (spatial profile of quantization noise and signals are not consistent), where the masking level threshold is low and, as a result the rate is high. In addition, the B-format coefficients can be strongly statistically interdependent, which means vector quantization is required to obtain high efficiency (note that methods for decorrelation of the coefficients would make the method a transform approach). An approach to coding the B-format coefficients directly is explored in more detail below, which describes a masking constrained directional coding algorithm.

In the transform coding paradigm it can seem difficult to preserve the scalability inherent in the ambisonics representation, which would be a disadvantage. However, one could construct a transform domain where the signals to be coded are statistically independent. This has at least two advantages:

1) The quantization noise and the signal have the same spatial profile, leading to a higher masking threshold and a lower rate.
2) The separate coding of independent signals does not incur coding loss.

As will be seen below it is furthermore possible to obtain a scalable setup for the transform coding paradigm. This can mean that the transform approach is a good way to proceed.

The following discussion briefly describes an approach of directional decomposition as a standalone transform coding example. It does not exploit the potential advantages of transform coding. In the direction-decomposition transform, many of the transform-domain signals are highly correlated, as they describe different wall reflections for the same source signal. Thus, the spatial profile of the quantization noise and the underlying source signals are different, leading to a low masking level and, hence, a high rate. Moreover, the high correlation between the channels means that independent coding of the channels may not be optimal. Directional-coding also is not scalable. For example, if only a single channel remains, then it would describe a particular signal coming from a particular direction. That means it is not the best representation of the soundfield, which would be the mono channel.

The following description relates to coding ambisonics using independent sources. As discussed above, both optimal coding and a high masking threshold can be obtained by decomposing the ambisonics representation into independent signals. A coding scheme then first transforms the ambisonics coefficient signals. The resulting independent signals are then encoded. They are decoded when or where the signal is needed. Finally the set of decoded signals are added to provide a single ambisonics representation of the acoustic scenario.

Assume a time-invariant spatial arrangement and let B represent a stacking of coefficients $B_n^m(l, q)$ over order n and mode m for a certain ambisonics order N (so equation (3) is truncated at n=N) at a particular time and frequency. Then, one manner to obtain independent sources for ambisonics is to find the time-invariant, frequency-dependent demixing matrix M(q) or a time-invariant, frequency-dependent mixing matrix A(q) such that $$B(l,q)=M(q)S(l,q) \tag{14}$$

$$S(l,q)=A(q)B(l,q). \tag{15}$$

In equations (14) and (15), $B(\bullet, k) \in \mathbb{R}^{N^2\times\mathbb{Z}}$ is an $N^2$-dimensional vector process and $S(\bullet, k) \in \mathbb{R}^{|\mathcal{J}|\times\mathbb{Z}}$ is an $|\mathcal{J}|$-dimensional vector process, where $\mathcal{J}$ is the set of independent source signals.

If M(q) and B(•, q) are known, then one can use the minimum energy S(•, q):

$$A(q)=M(q)^H(M(q)M(q)^H)^{-1}, \tag{16}$$

as this inverse will remove any energy not lying in the image of M(q).

Blind source separation (BSS) methods are available and can potentially be used for finding a mapping B(•, q) to S(•, q). They may have drawbacks that carry over to the present ambisonics coding approach. The main drawback of the BSS based ambisonics coding method is that BSS methods generally require a significant amount of data before finding the mixing or demixing matrix. Hence a significant estimation delay may be required. However, once the mixing and demixing matrices are known, the actual processing (the demixing before encoding and the mixing after decoding) requires delays that depend only on the block size of the transform. Generally, a larger block size performs better for a time-invariant scenario, but requires a longer processing delay.

BSS algorithms may have additional drawbacks. Some BSS algorithms suffer from a filtering ambiguity and frequency domain methods generally suffer from the so-called permutation ambiguity. Various methods for addressing the permutation ambiguity exist. As for the filtering ambiguity, it may appear that it is of no consequence if one remixes the signal after decoding to obtain the ambisonics representation. However, it can affect the masking of the coding scheme used to encode the independent signals.

One approach to account for the filtering ambiguity is to replace the mixing matrix M(k) with its normalized equivalent:

$$M'_{ji}(q) = \frac{M_{ji}(q)}{M_{0i}(q)}. \tag{17}$$

The operation (17) normalizes each source signal such that its gain is equal to the gain in the mono channel of the ambisonics representation. To account for the filtering ambiguity for the demixing matrix one can use equation (16) in conjunction with equation (17).

If properly normalized, the coding of the individual dimensions of the time-frequency signals S(l, q) can be performed independently with existing single-channel audio coders and with conventional single-channel masking considerations (as the source and its quantization noise share their spatial profile). For this purpose the individual dimensions of the time-frequency signals S(l, q), can be converted to time-domain signals by equation (5). The masking of one source by another source can be ignored in this paradigm, which can be justified from the fact that individual sources may dominate the signal perceived by the listener under a specific orientation of the listener, and the paradigm effectively represents a minimax approach.

Figure 3:
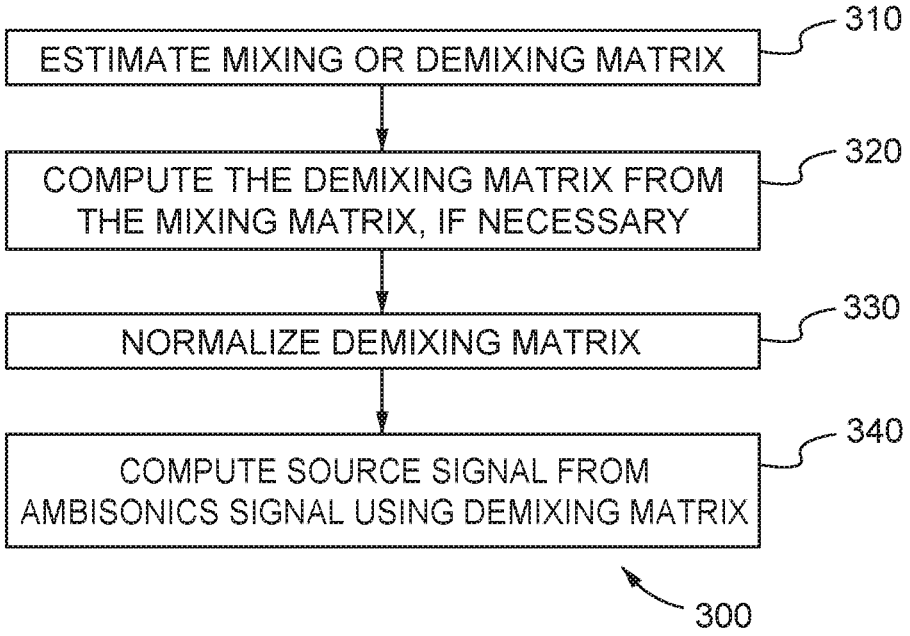
FIG. 3 shows an example of a process.

FIG. 3 shows an example of a source-separation process 300 for a particular frequency q. At 310, a mixing matrix or a demixing matrix can be estimated from observations of B(•, q). For example, this can be the demixing matrix in equation (14) or the mixing matrix in equation (15). At 320, the demixing matrix can be computed from the mixing matrix, if necessary. At 330, the demixing matrix can be normalized. For example, this can be done as shown in equation (17). At 340, the source signal S(l, q) can be computed from the ambisonics signal B(l, q) using the demixing matrix.

The following describes how to make the coding system based on independent sources scalable. One can obtain scalability by using the mono signal appropriately. The resulting scalability replaces the scalability of the ambisonics B format, but is based on a different principle. At the lowest bit rate, one can encode only the mono (zero-order) signal. The mono channels themselves can be varying in rate. With increasing rate one can add additional extracted sources but retain the mono channel. While the mono channel should be used in the estimation of the source signals as it provides useful information, it is not included in the mixing process as it is already complete. That is, the first row of equation (14), which specifies the zero-order ambisonics channel, can be omitted and the coded ambisonics channel is taken instead. To summarize, with increasing rate, the coded signal contains progressively more components. Except for the first component signal, which is the mono channel, the component signals each describe an independent sound source.

Figure 4:
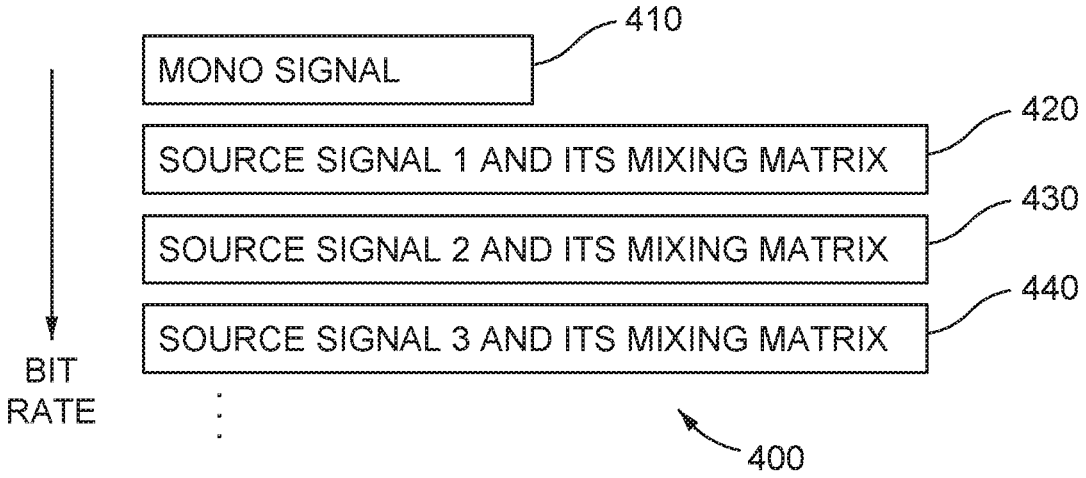
FIG. 4 shows examples of signals.

FIG. 4 shows examples of signals 400. Here, a signal 410 corresponds to a lowest rate. For example, the signal 410 can include a mono signal. Signal 420 can correspond to a next order. For example, the signal 420 can include a source signal 1 and its ambisonics mixing matrix. Signal 430 can correspond to a next order. For example, the signal 430 can include a source signal 2 and its ambisonics mixing matrix. Signal 440 can correspond to a next order. For example, the signal 440 can include a source signal 3 and its ambisonics mixing matrix. The ambisonics mixing matrices can be time-invariant for time-invariant spatial arrangements and, therefore, require only a relatively low transmission rate under this condition.

The following describes a specific BSS algorithm. In some implementations, a directional decomposition method can be used as a pre-processor. For example, this can be the method described below. The algorithm relates to independent source extraction for ambisonics and includes:

Using a directional-decomposition map B→S'

Estimating RMS power $$\alpha_j = \frac{1}{|\mathcal{L}|}\sqrt{\sum_{l\in\mathcal{L}} |S'_j(l, q)|^2}$$

Performing scale-invariant clustering $S'_j(l,\bullet)$, (e.g., using affinity propagation)

Mixing matrix row i is $M_i = \Sigma_{j\in\mathcal{C}_i} \alpha_j Y(\theta_j, \phi_j)$ The BSS algorithm can be run per frequency bin k and can assume that the directional signals generally contain only a single source (as they represent a path to that source). The directional signals (which form the rows of the vector process consisting of all signals in all loudspeakers) can then be clustered, a cluster $\mathcal{C}_i$ containing the indices to a set of directional signals associated with a particular sound source $i \in \mathcal{I}$. The clustering must be invariant with a complex scale factor for the signals and can be based on, for example, affinity propagation. Single-signal (singleton) clusters consist of multiple source signals may not be considered.

The following description relates to a Greedy directional decomposition with point sources at infinity. Consider an ambisonics representation of order N characterized by a set of coefficients $B_n^m$. A goal may be to approximate these coefficients with the sum of the ambisonics representation of a set of signals generated by virtual loudspeakers placed on a sphere of infinite radius. Equivalently, this can be considered to be an expansion into a finite set of plane waves as specified in equation (6). That is, if one has a set of virtual loudspeakers $\mathcal{I}$ with locations $(\theta_i, \phi_i)$ then each ambisonic coefficient can be represented as $$B_n^m(l, q) = \sum_{i\in\mathcal{I}} S_i(l, q) Y_{nm}(\theta_i, \phi_i) + \epsilon^{1\times 1} \tag{18}$$

$$= Y_{nm}^T S(l, q) + \epsilon^{1\times 1} \tag{19}$$

where $S(l, q) = [S_1(l, q), \ldots, S_{|\mathcal{I}|}(l, q)]^T$ is a driving signal vector, $Y_{nm} = [Y_{nm}(\theta_1, \phi_1), \ldots, Y_{nm}(\theta_{|\mathcal{I}|}, \phi_{|\mathcal{I}|})]^T$ is a virtual-loudspeaker gain vector and $\epsilon^\gamma$ is a scalar error with γ indicating its dimensionality.

One can stack all ambisonics coefficients $B_n^m(l, q)$ for a particular time and frequency and do the same for the spherical harmonics vectors $Y_{nm}$ to obtain:

$$B(l,q) = Y^T S(l,q) + \epsilon^{(N+1)^2\times 1}, \tag{20}$$

where, since $\Sigma_{n=0}^{N} 2n+1 = (N+1)^2$, one obtains that $S(l, q) \in \mathbb{R}^{|\mathcal{I}|\times 1}$, that $B(l, k) \in \mathbb{R}^{(N+1)^2\times 1}$ and that $Y \in \mathbb{R}^{|\mathcal{I}|\times(N+1)^2}$.

Consider now the case where one optimizes over a rectangular time-frequency patch $\{(l, k): L_0 \le l < L_1, K_0 \le q < K_1\}$. Here, the shape is for illustrative purposes only; any other shape can be used without adjusting the algorithm. Assume that within the band the location of the point source is shared across the frequencies. One can then generalize equation (26) to $$B = Y^T S + \epsilon^{(N+1)^2\times LK}, \tag{21}$$

where $B = [B(L_0, K_0), \ldots, B(L_1-1, K_1-1)] \in \mathbb{R}^{(N+1)^2\times LK}$ and $S = [S(L_0, K_0), \ldots, S(L_1-1, K_1-1)] \in \mathbb{R}^{|\mathcal{I}|\times LK}$, where one has defined $LK=(L_1-L_0)(K_1-K_0)$. It can be seen that the number of signals goes from $(N+1)^2$ to the set cardinality $|\mathcal{J}|$. $\mathcal{J}$ The Frobenius norm is denoted by $\|\bullet\|_F$ and the directional decomposition approximation with $$\hat{B}=Y^T S. \tag{22}$$

Equation (22) can be seen as a synthesis operation: it creates the ambisonics representation from the signals in the directional decomposition representation, S with a straightforward matrix multiplication. To perform the corresponding analysis, one can perform a matching pursuit algorithm to find both the set of $S_j(k)$ and the set of $(\theta_j, \phi_j)$ for that frequency band. The algorithm can be stopped at a certain residual error or after a fixed number of iterations. The algorithm relates to a directional decomposition matching pursuit and returns time-frequency patch signals S corresponding to location set $\mathcal{J}$, where $\mathbb{C}$ is the set of complex numbers. The algorithm can include:

```
Initialize loudspeaker location set {φp, θp}p∈P
Set itermax
iter = 0
r = B
B̂ = 0
ℒ = Ø
while iter < itermax do
  j = argmin_{p∈P} min_{s∈C^{1×KL}} ||r − Y(θp, φp)s||F
  S = min_{s∈C^{1×KL}} ||r − Y(θj, φj)s||F
  B̂ = B̂ + Y(θj, φj)S
  r = r − Y(θj, φj)S
  𝒥 = J + {j}
  iter = iter + 1
end while
```

In principle, the above algorithm returns more consistent values for the selected point set $\mathcal{L}$ for larger time-frequency patches. In general the optimal point set $\mathcal{L}$ varies with frequency, but depending on the physical arrangement and the frequency, consistency in the loudspeaker locations found may be expected within frequency bands. For time-invariant spatial arrangements, the optimal point set should not vary in time. Hence the time duration of the patch can be made relatively long.

Figure 5:
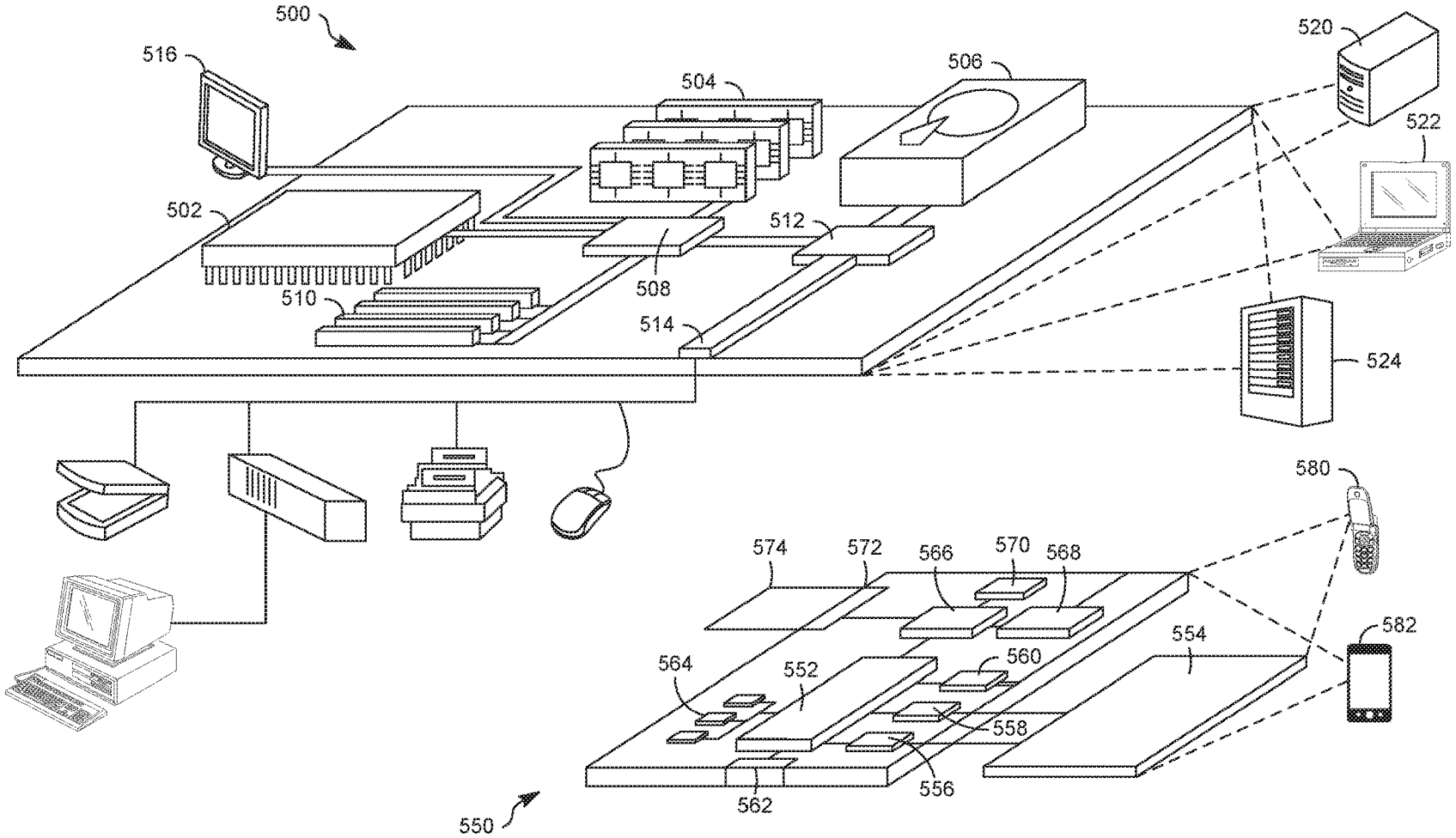
FIG. 5 shows an example of a computer device and a mobile computer device that can be used to implement the techniques described here.

FIG. 5 shows an example of a generic computer device 500 and a generic mobile computer device 550, which may be used with the techniques described here. Computing device 500 is intended to represent various forms of digital computers, such as laptops, desktops, tablets, workstations, personal digital assistants, televisions, servers, blade servers, mainframes, and other appropriate computing devices. Computing device 550 is intended to represent various forms of mobile devices, such as personal digital assistants, cellular telephones, smart phones, and other similar computing devices. The components shown here, their connections and relationships, and their functions, are meant to be exemplary only, and are not meant to limit implementations of the inventions described and/or claimed in this document.

Computing device 500 includes a processor 502, memory 504, a storage device 506, a high-speed interface 508 connecting to memory 504 and high-speed expansion ports 510, and a low speed interface 512 connecting to low speed bus 514 and storage device 506. The processor 502 can be a semiconductor-based processor. The memory 504 can be a semiconductor-based memory. Each of the components 502, 504, 506, 508, 510, and 512, are interconnected using various busses, and may be mounted on a common motherboard or in other manners as appropriate. The processor 502 can process instructions for execution within the computing device 500, including instructions stored in the memory 504 or on the storage device 506 to display graphical information for a GUI on an external input/output device, such as display 516 coupled to high speed interface 508. In other implementations, multiple processors and/or multiple buses may be used, as appropriate, along with multiple memories and types of memory. Also, multiple computing devices 500 may be connected, with each device providing portions of the necessary operations (e.g., as a server bank, a group of blade servers, or a multi-processor system).

The memory 504 stores information within the computing device 500. In one implementation, the memory 504 is a volatile memory unit or units. In another implementation, the memory 504 is a non-volatile memory unit or units. The memory 504 may also be another form of computer-readable medium, such as a magnetic or optical disk.

The storage device 506 is capable of providing mass storage for the computing device 500. In one implementation, the storage device 506 may be or contain a computer-readable medium, such as a floppy disk device, a hard disk device, an optical disk device, or a tape device, a flash memory or other similar solid state memory device, or an array of devices, including devices in a storage area network or other configurations. A computer program product can be tangibly embodied in an information carrier. The computer program product may also contain instructions that, when executed, perform one or more methods, such as those described above. The information carrier is a computer- or machine-readable medium, such as the memory 504, the storage device 506, or memory on processor 502.

The high speed controller 508 manages bandwidth-intensive operations for the computing device 500, while the low speed controller 512 manages lower bandwidth-intensive operations. Such allocation of functions is exemplary only. In one implementation, the high-speed controller 508 is coupled to memory 504, display 516 (e.g., through a graphics processor or accelerator), and to high-speed expansion ports 510, which may accept various expansion cards (not shown). In the implementation, low-speed controller 512 is coupled to storage device 506 and low-speed expansion port 514. The low-speed expansion port, which may include various communication ports (e.g., USB, Bluetooth, Ethernet, wireless Ethernet) may be coupled to one or more input/output devices, such as a keyboard, a pointing device, a scanner, or a networking device such as a switch or router, e.g., through a network adapter.

The computing device 500 may be implemented in a number of different forms, as shown in the figure. For example, it may be implemented as a standard server 520, or multiple times in a group of such servers. It may also be implemented as part of a rack server system 524. In addition, it may be implemented in a personal computer such as a laptop computer 522. Alternatively, components from computing device 500 may be combined with other components in a mobile device (not shown), such as device 550. Each of such devices may contain one or more of computing device 500, 550, and an entire system may be made up of multiple computing devices 500, 550 communicating with each other.

Computing device 550 includes a processor 552, memory 564, an input/output device such as a display 554, a communication interface 566, and a transceiver 568, among other components. The device 550 may also be provided with a storage device, such as a microdrive or other device, to provide additional storage. Each of the components 550, 552, 564, 554, 566, and 568, are interconnected using various buses, and several of the components may be mounted on a common motherboard or in other manners as appropriate.

The processor 552 can execute instructions within the computing device 550, including instructions stored in the memory 564. The processor may be implemented as a chipset of chips that include separate and multiple analog and digital processors. The processor may provide, for example, for coordination of the other components of the device 550, such as control of user interfaces, applications run by device 550, and wireless communication by device 550.

Processor 552 may communicate with a user through control interface 558 and display interface 556 coupled to a display 554. The display 554 may be, for example, a TFT LCD (Thin-Film-Transistor Liquid Crystal Display) or an OLED (Organic Light Emitting Diode) display, or other appropriate display technology. The display interface 556 may comprise appropriate circuitry for driving the display 554 to present graphical and other information to a user. The control interface 558 may receive commands from a user and convert them for submission to the processor 552. In addition, an external interface 562 may be provide in communication with processor 552, so as to enable near area communication of device 550 with other devices. External interface 562 may provide, for example, for wired communication in some implementations, or for wireless communication in other implementations, and multiple interfaces may also be used.

The memory 564 stores information within the computing device 550. The memory 564 can be implemented as one or more of a computer-readable medium or media, a volatile memory unit or units, or a non-volatile memory unit or units. Expansion memory 574 may also be provided and connected to device 550 through expansion interface 572, which may include, for example, a SIMM (Single In Line Memory Module) card interface. Such expansion memory 574 may provide extra storage space for device 550, or may also store applications or other information for device 550. Specifically, expansion memory 574 may include instructions to carry out or supplement the processes described above, and may include secure information also. Thus, for example, expansion memory 574 may be provide as a security module for device 550, and may be programmed with instructions that permit secure use of device 550. In addition, secure applications may be provided via the SIMM cards, along with additional information, such as placing identifying information on the SIMM card in a non-hackable manner.

The memory may include, for example, flash memory and/or NVRAM memory, as discussed below. In one implementation, a computer program product is tangibly embodied in an information carrier. The computer program product contains instructions that, when executed, perform one or more methods, such as those described above. The information carrier is a computer- or machine-readable medium, such as the memory 564, expansion memory 574, or memory on processor 552, that may be received, for example, over transceiver 568 or external interface 562.

Device 550 may communicate wirelessly through communication interface 566, which may include digital signal processing circuitry where necessary. Communication interface 566 may provide for communications under various modes or protocols, such as GSM voice calls, SMS, EMS, or MMS messaging, CDMA, TDMA, PDC, WCDMA, CDMA2000, or GPRS, among others. Such communication may occur, for example, through radio-frequency transceiver 568. In addition, short-range communication may occur, such as using a Bluetooth, WiFi, or other such transceiver (not shown). In addition, GPS (Global Positioning System) receiver module 570 may provide additional navigation- and location-related wireless data to device 550, which may be used as appropriate by applications running on device 550.

Device 550 may also communicate audibly using audio codec 560, which may receive spoken information from a user and convert it to usable digital information. Audio codec 560 may likewise generate audible sound for a user, such as through a speaker, e.g., in a handset of device 550. Such sound may include sound from voice telephone calls, may include recorded sound (e.g., voice messages, music files, etc.) and may also include sound generated by applications operating on device 550.

The computing device 550 may be implemented in a number of different forms, as shown in the figure. For example, it may be implemented as a cellular telephone 580. It may also be implemented as part of a smart phone 582, personal digital assistant, or other similar mobile device.

Various implementations of the systems and techniques described here can be realized in digital electronic circuitry, integrated circuitry, specially designed ASICs (application specific integrated circuits), computer hardware, firmware, software, and/or combinations thereof. These various implementations can include implementation in one or more computer programs that are executable and/or interpretable on a programmable system including at least one programmable processor, which may be special or general purpose, coupled to receive data and instructions from, and to transmit data and instructions to, a storage system, at least one input device, and at least one output device.

These computer programs (also known as programs, software, software applications or code) include machine instructions for a programmable processor, and can be implemented in a high-level procedural and/or object-oriented programming language, and/or in assembly/machine language. As used herein, the terms "machine-readable medium" "computer-readable medium" refers to any computer program product, apparatus and/or device (e.g., magnetic discs, optical disks, memory, Programmable Logic Devices (PLDs)) used to provide machine instructions and/or data to a programmable processor, including a machine-readable medium that receives machine instructions as a machine-readable signal. The term "machine-readable signal" refers to any signal used to provide machine instructions and/or data to a programmable processor.

To provide for interaction with a user, the systems and techniques described here can be implemented on a computer having a display device (e.g., a CRT (cathode ray tube) or LCD (liquid crystal display) monitor) for displaying information to the user and a keyboard and a pointing device (e.g., a mouse or a trackball) by which the user can provide input to the computer. Other kinds of devices can be used to provide for interaction with a user as well; for example, feedback provided to the user can be any form of sensory feedback (e.g., visual feedback, auditory feedback, or tactile feedback); and input from the user can be received in any form, including acoustic, speech, or tactile input.

The systems and techniques described here can be implemented in a computing system that includes a back end component (e.g., as a data server), or that includes a middleware component (e.g., an application server), or that includes a front end component (e.g., a client computer having a graphical user interface or a Web browser through which a user can interact with an implementation of the systems and techniques described here), or any combination of such back end, middleware, or front end components. The components of the system can be interconnected by any form or medium of digital data communication (e.g., a communication network). Examples of communication networks include a local area network ("LAN"), a wide area network ("WAN"), and the Internet.

The computing system can include clients and servers. A client and server are generally remote from each other and typically interact through a communication network. The relationship of client and server arises by virtue of computer programs running on the respective computers and having a client-server relationship to each other.

A number of embodiments have been described. Nevertheless, it will be understood that various modifications may be made without departing from the spirit and scope of the invention.

In addition, the logic flows depicted in the figures do not require the particular order shown, or sequential order, to achieve desirable results. In addition, other steps may be provided, or steps may be eliminated, from the described flows, and other components may be added to, or removed from, the described systems. Accordingly, other embodiments are within the scope of the following claims.

What is claimed is:

1. A method comprising:

receiving a representation of a soundfield, the representation characterizing the soundfield around a point in space;

decomposing the received representation into independent signals comprising a mono channel and a number of independent source channels; and encoding the independent signals, wherein a quantization noise for at least one of the independent signals has a common spatial profile with the independent signal.

2. The method of claim 1, wherein decomposing the received representation comprises transforming the received representation.

3. The method of claim 2, wherein the transformation involves a demixing matrix, the method further comprising accounting for a filtering ambiguity by replacing the demixing matrix with a normalized demixing matrix.

4. The method of claim 1, wherein the representation of the soundfield corresponds to a time-invariant spatial arrangement.

5. The method of claim 1, further comprising determining a demixing matrix, and using the demixing matrix in computing a source signal from an ambisonics signal.

6. The method of claim 5, further comprising estimating a mixing matrix from observations of the ambisonics signal, and computing the demixing matrix from the estimated mixing matrix.

7. The method of claim 6, further comprising normalizing the determined demixing matrix, and using the normalized demixing matrix in computing the source signal.

8. The method of claim 1, further comprising performing blind source separation on the received representation of the soundfield.

9. The method of claim 8, wherein performing the blind source separation comprises using a directional-decomposition map, estimating an RMS power, performing a scale-invariant clustering, and applying a mixing matrix.

10. The method of claim 8, further comprising performing a directional decomposition as a pre-processor for the blind source separation.

11. The method of claim 10, wherein performing the directional decomposition comprises an iterative process that returns time-frequency patch signals corresponding to a location set for loudspeakers.

12. The method of claim 1, further comprising making the encoding scalable.

13. The method of claim 12, wherein making the encoding scalable comprises encoding only a zero-order signal at a lowest bit rate, and with increasing bit rate, adding one or more extracted source signals and retaining the zero-order signal.

14. The method of claim 13, further comprising excluding the zero-order signal from a mixing process.

15. A computer program product tangibly embodied in a non-transitory storage medium, the computer program product including instructions that when executed cause a processor to perform operations including:

receiving a representation of a soundfield, the representation characterizing the soundfield around a point in space;

decomposing the received representation into independent signals, including transforming the received representation using a normalized demixing matrix to account for a filtering ambiguity; and encoding the independent signals, wherein a quantization noise for any of the independent signals has a common spatial profile with the independent signal.

16. The computer program product of claim 15, wherein the independent signals comprise a mono channel and a number of independent source channels.

17. A system comprising:

a processor; and a computer program product tangibly embodied in a non-transitory storage medium, the computer program product including instructions that when executed cause the processor to perform operations including:

receiving a representation of a soundfield, the representation characterizing the soundfield around a point in space;

decomposing the received representation into independent signals; and encoding the independent signals, wherein a quantization noise for any of the independent signals has a common spatial profile with the independent signal, and wherein the encoding is scalable in that only a zero-order signal is encoded at a lowest bit rate, and with increasing bit rate, one or more extracted source signals are added and the zero-order signal is retained.

18. The system of claim 17, wherein the independent signals comprise a mono channel and a number of independent source channels.

19. The system of claim 17, wherein the operations further comprise performing a directional decomposition as a pre-processor for the blind source separation, including an iterative process that returns time-frequency patch signals corresponding to a location set for loudspeakers.

20. The computer program product of claim 15, wherein the operations further comprise determining a demixing matrix, using the demixing matrix in computing a source signal from an ambisonics signal, estimating a mixing matrix from observations of the ambisonics signal, and computing the demixing matrix from the estimated mixing matrix.

* * * * *